US010953523B2

(12) United States Patent
Lai

(10) Patent No.: US 10,953,523 B2
(45) Date of Patent: Mar. 23, 2021

(54) INSULATING RATCHET DRIVER WITH PIVOTING HEAD

(71) Applicant: WEI CHINS PLASTIC ENTERPRISE CORP., Taichung (TW)

(72) Inventor: Jin-Tsai Lai, Taichung (TW)

(73) Assignee: WEI CHINS PLASTIC ENTERPRISE CORP., Taichung (TW)

( * ) Notice: Subject to any disclaimer, the term of this patent is extended or adjusted under 35 U.S.C. 154(b) by 167 days.

(21) Appl. No.: 16/082,927

(22) PCT Filed: Dec. 16, 2016

(86) PCT No.: PCT/CN2016/110306

§ 371 (c)(1),
(2) Date: Sep. 6, 2018

(87) PCT Pub. No.: WO2018/107454

PCT Pub. Date: Jun. 21, 2018

(65) Prior Publication Data

US 2019/0054600 A1 Feb. 21, 2019

(30) Foreign Application Priority Data

Dec. 13, 2016 (CN) ..... 201621364482.X

(51) Int. Cl.

| | |
|---|---|
| ***B25B 15/04*** | (2006.01) |
| ***B25B 13/46*** | (2006.01) |
| ***B25G 1/12*** | (2006.01) |
| ***B25B 23/00*** | (2006.01) |
| ***B25G 3/38*** | (2006.01) |

(52) U.S. Cl.

CPC ..... *B25B 15/04* (2013.01); *B25B 13/463* (2013.01); *B25B 23/0021* (2013.01); *B25B 23/0028* (2013.01); *B25B 23/0035* (2013.01); *B25B 23/0042* (2013.01); *B25G 1/125* (2013.01); *B25G 3/38* (2013.01); *B25B 13/468* (2013.01)

(58) Field of Classification Search

CPC ... B25B 15/04; B25B 13/463; B25B 23/0021; B25B 23/0028; B25B 23/0035; B25B 23/0042; B25B 13/468; B25B 13/461; B25B 13/46; B25B 13/462; B25B 15/02; B25B 15/06; B25B 23/00; B25G 1/125; B25G 3/38; B25G 1/063

See application file for complete search history.

(56) References Cited

U.S. PATENT DOCUMENTS

| | | | | |
|---|---|---|---|---|
| 2,742,808 A * | 4/1956 | Haberle | B25B 13/28 | 81/99 |
| 6,216,567 B1 * | 4/2001 | Hu | B25G 1/063 | 81/177.6 |
| 6,871,569 B1 * | 3/2005 | Chen | B25G 1/063 | 81/177.7 |
| 2011/0314973 A1 * | 12/2011 | Tsai | B25B 13/461 | 81/60 |

(Continued)

*Primary Examiner* — Robert J Scruggs

(57) ABSTRACT

An insulating ratchet driver with pivoting head has: a handle, a spring, a pressing knob, a driving head and a pivoting member. The pivoting member is provided with a cover made of an insulating material. All metal portions of the handle, the pressing knob and the driving head are coated with an insulating layer.

2 Claims, 5 Drawing Sheets

(56) References Cited

U.S. PATENT DOCUMENTS

2015/0266172 A1* 9/2015 Kuo ..... B25B 13/463
81/60
2016/0176029 A1* 6/2016 Hsieh ..... B25B 23/1425
81/467

* cited by examiner

INSULATING RATCHET DRIVER WITH PIVOTING HEAD

BACKGROUND OF INVENTION

1. Field of Invention

The present invention relates to a ratchet driver, and more particularly to an insulating ratchet driver with pivoting head.

2. Description of Related Art

According to the conventional ratchet driver, as shown in the attached article, the "Retraction Ratchet Structure and Swing Head" of the Taiwan Patent No. 428515, however, the conventional ratchet screwdriver is found to have the following defects: 1. The parts of the conventional ratchet driver are not effectively insulated, so there is possibility of electric shock for the user. 2. The control shaft 80 of the conventional ratchet driver push the steel ball 81 into the positioning groove 12 of the connecting piece 10 after the connecting piece 10 is swung over the control shaft 80. But the additional steel ball 81 will make the overall structure more complicated and the only one quarter of the spherical surface of the steel ball 81 is used as a contact range, which provides the poor stability.

Therefore, it is desirable to provide an insulating ratchet driver with pivoting head to mitigate and/or obviate the aforementioned problems.

SUMMARY OF INVENTION

An objective of present invention is to provide an insulating ratchet driver with pivoting head, which is capable of improving the above-mention problems.

In order to achieve the above mentioned objective, an insulating ratchet driver with pivoting head has: a handle, a spring, a pressing knob, a driving head and a pivoting member. The pivoting member is provided with a cover made of an insulating material. All metal portions of the handle, the pressing knob and the driving head are coated with an insulating layer.

Other objects, advantages, and novel features of invention will become more apparent from the following detailed description when taken in conjunction with the accompanying drawings.

DETAILED DESCRIPTION OF PREFERRED EMBODIMENT

Figure 1:
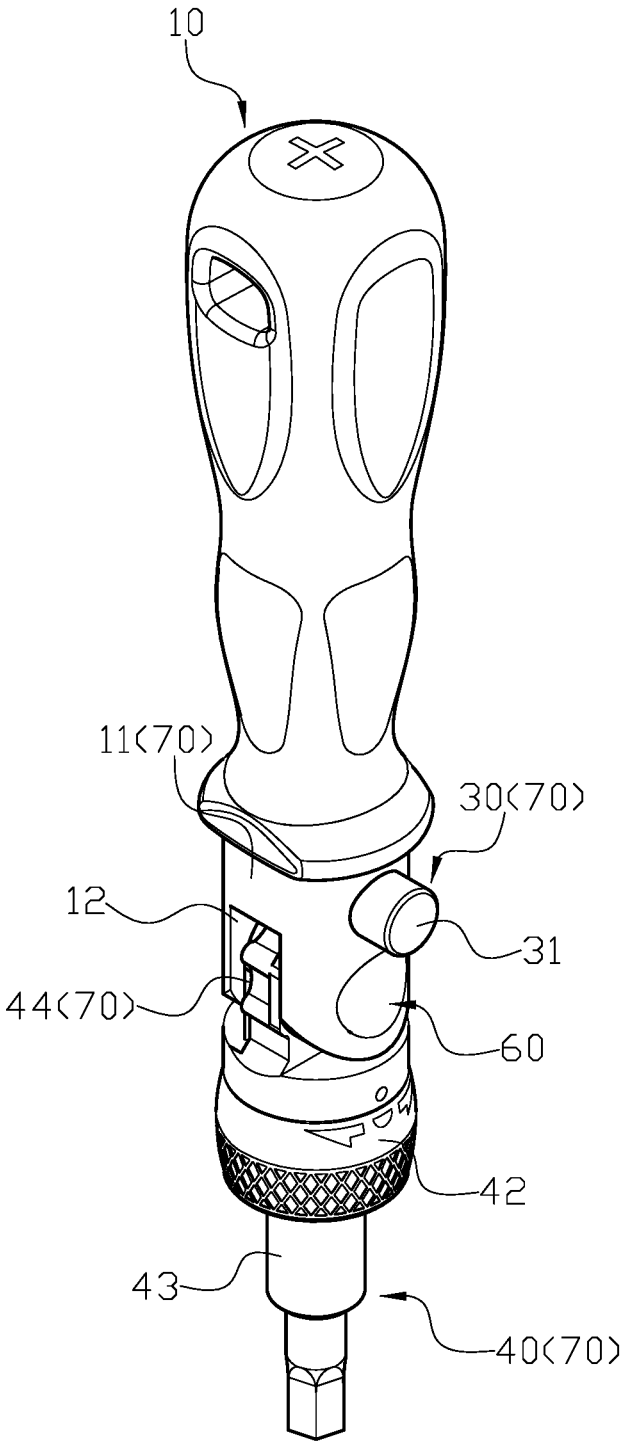
FIG. 1 is a perspective drawing of a preferred embodiment according to the present invention.
Figure 2:
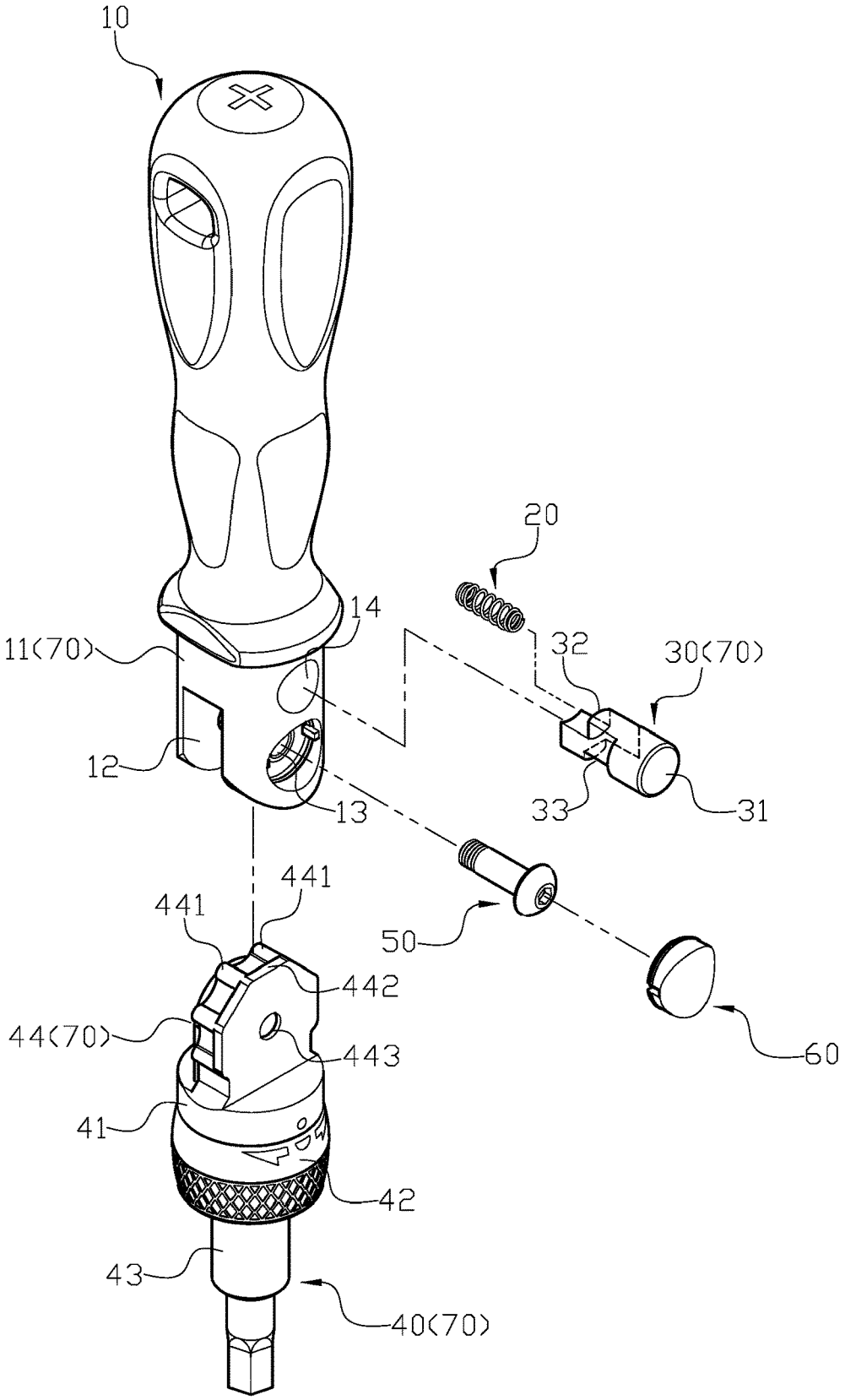
FIG. 2: is a perspective exploded view of the preferred embodiment according to the present invention.
Figure 3:
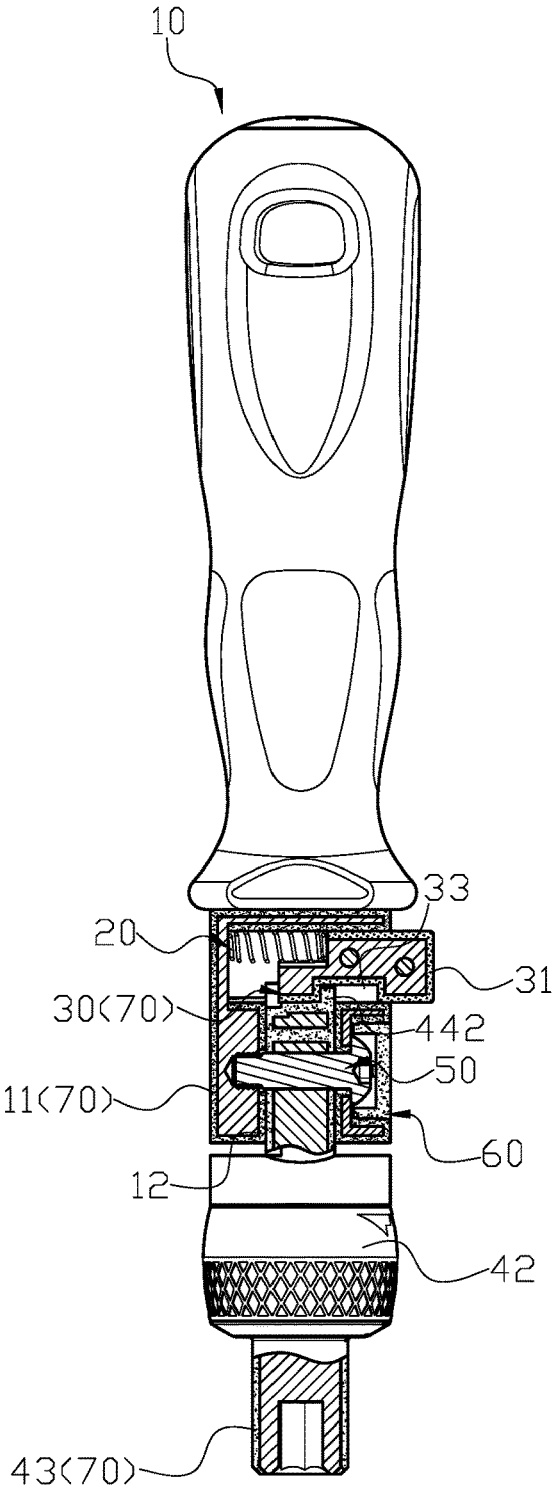
FIG. 3 is an assembly drawing of the preferred embodiment according to the present invention.

Please refer to FIGS. 1, 2 and 3. A ratchet driver comprises: a handle 10, a spring 20, a pressing knob 30, a driving head 40 and a pivoting member 50. the pivoting member 50 is provided with a cover 60 made of an insulating material, and all exposed metal portions of the handle 10, the pressing knob 30 and the driving head 40 are coated with an insulating layer 70. An end of the handle 10 has an assembling portion 11, the assembling portion 11 has an opening 12, and a side of the assembling portion 11 provided with a pivoting aperture 13 and a socket 14 passing through the opening 12. The socket 14 is disposed adjacent to the handle 10, and the spring 20 and the pressing knob 30 are disposed in the socket 14. The pressing knob 30 has a first end 31 and a second end 32, and an escaping gap 33 is provided between the first end 31 and the second end 32 on a bottom of the pressing knob 30. The spring 20 disposed in the socket 14 respectively pushes the socket 14 and the second end 32 of the pressing knob 30 so the first end 31 of the pressing knob 30 is pressed to retract the pressing knob 30 while the escaping gap 33 is aligned with the opening 12. The driving head 40 has a main body 41 provided with a connecting rod 43 driven by a ratchet unit 42, and the ratchet unit 42 controls the engagement of the connecting rod 43. Another end of the main body 41 is provided with a toothed wheel 44, and a stopping edge 442 is provided between each tooth 441 of the toothed wheel 44. The toothed wheel 44 is further provided with a second pivoting aperture 443, and the toothed wheel 44 of the driving head is disposed in the opening 12 of the handle 10 such that the second pivoting aperture 443 of the toothed wheel 44 is aligned with the first pivoting aperture 13 of the opening 12. The pivoting member 50 is contained in the first and second pivoting apertures 13, 43, and the driving head 40 is pivoted onto the assembling portion 11 of the handle 10 via the toothed wheel 44. When the pressing knob 30 is biased by the spring 20 to urge the escaping gap 33 away from the opening 12 of the handle 10, such that the pressing knob 30 engages with two teeth 441 of the toothed wheel 44 and pushed against the stopping edge 442. With the cover 60, the pivoting aperture 13 of the handle 10 is enclosed, and the pivoting member 50 is completely hidden. Furthermore, the pivoting member 50 is coupled to the pivoting aperture 13 of the handle 10 by a screw locking design.

Figure 4:
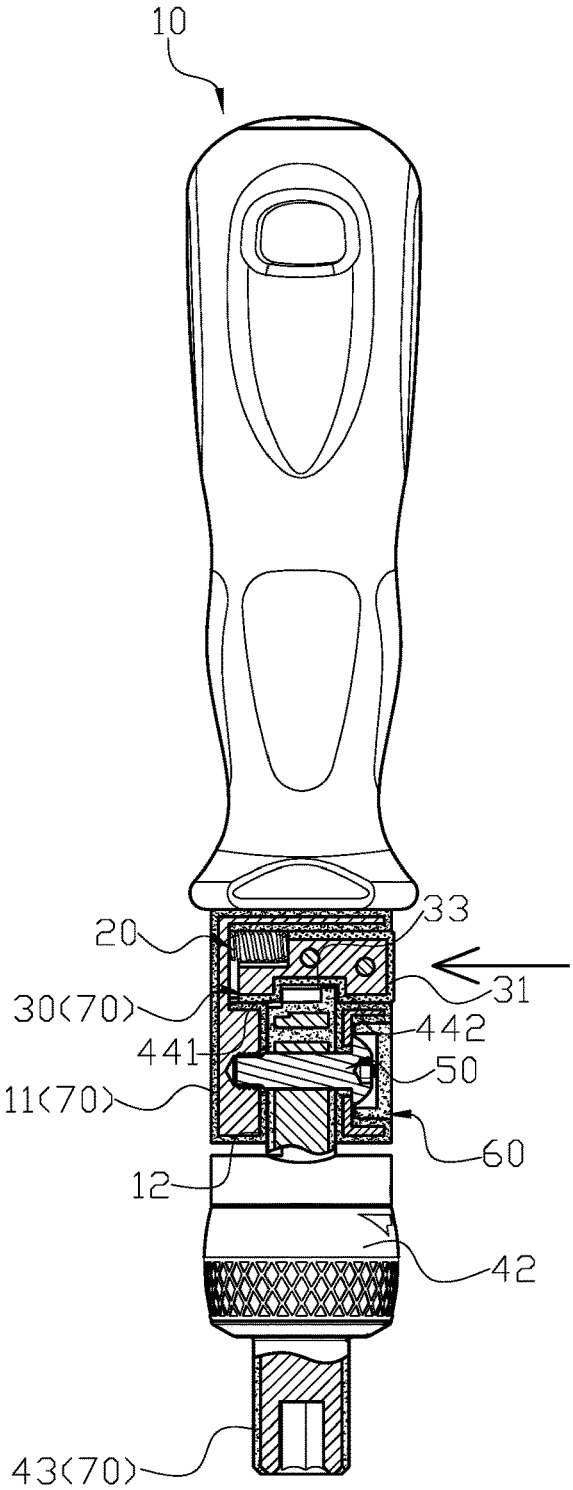
FIG. 4 shows a pressed state of the preferred embodiment according to the present invention.
Figure 5:
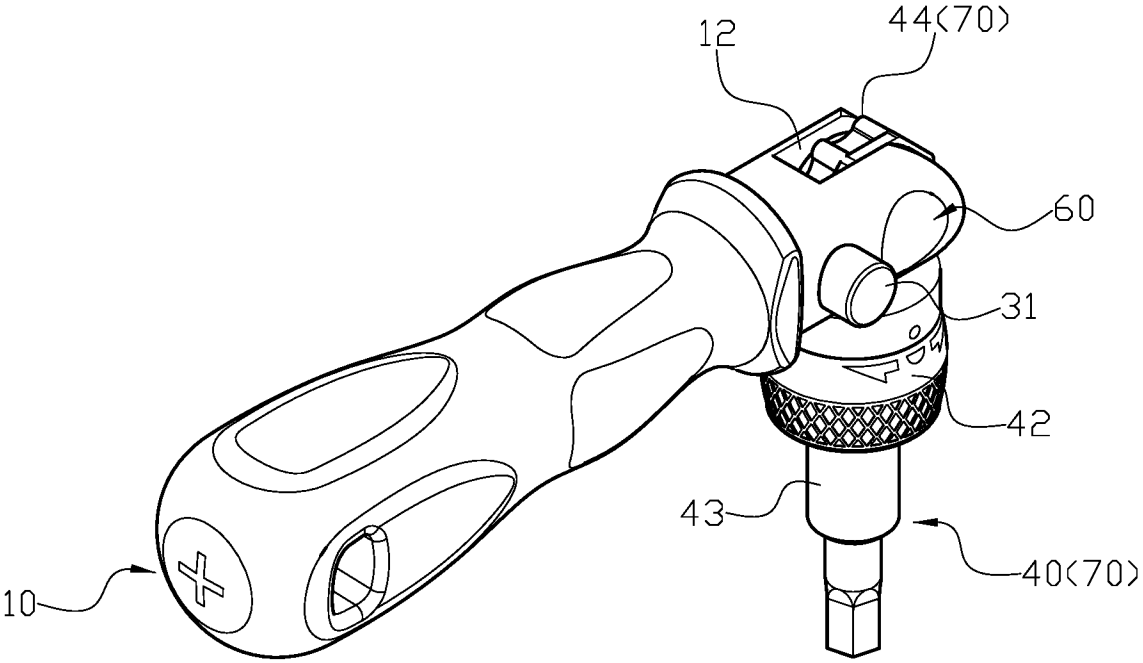
FIG. 5 is a perspective view after angle adjustment of the preferred embodiment according to the present invention.
Figure 6:
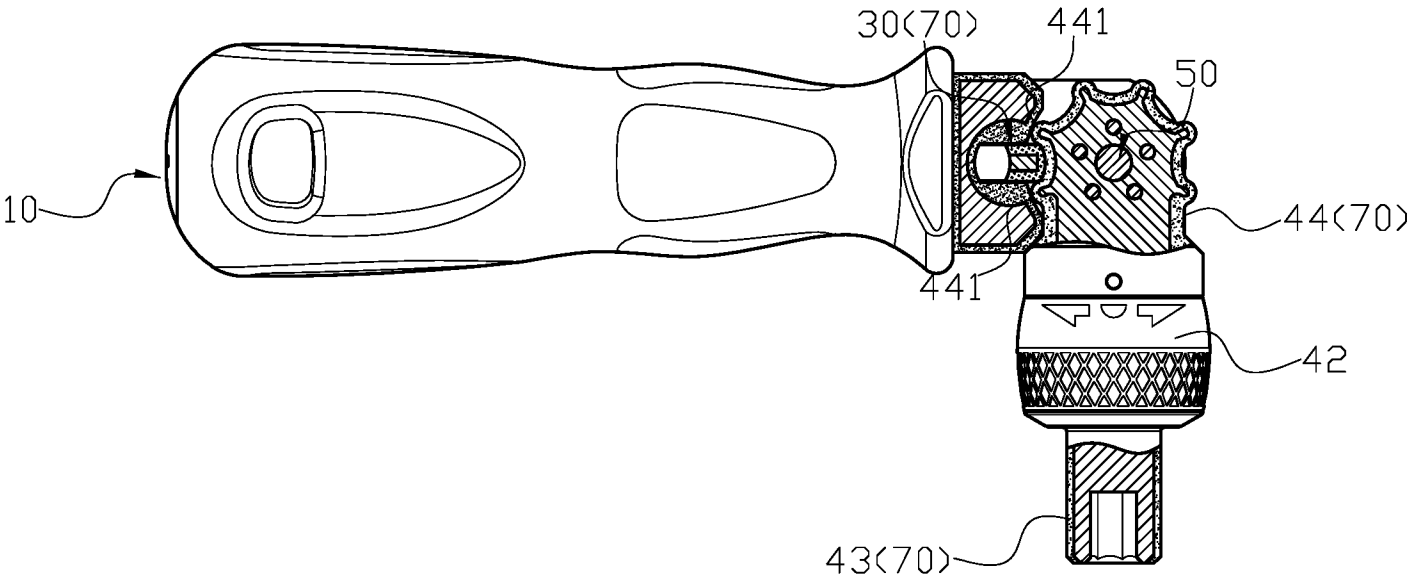
FIG. 6 is a cross-sectional view after angle adjustment of the preferred embodiment according to the present invention.

In actual use, when the first end 31 of the pressing knob 30 is pressed, as shown in FIG. 4, the escaping gap 33 is aligned to the opening 12, so that the toothed wheel 44 can be temporarily disengaged with the pressing knob 30, which allows the driving head 40 to smoothly swing on the handle 10. So the ratchet driver can be operated more smoothly. After the adjustment, the pressing knob 30 is released, which allows the pressing knob 30 to be re-engaged with the two teeth 44, as shown in FIG. 5 and FIG. 6, and the pressing knob 30 is stopped by the stopping edge 442 of the toothed wheel 44, Which achieves multi-plane contacts and provides a significant improvement in the stability when the driving head 40 is locked.

With the structure of the above specific embodiment, the following benefits can be obtained: The exposed metal portion of the handle 10, the pressing knob 30 and the driving head 40 is covered with an insulating layer 70, so that the whole driver can be completely insulated. The effect of the insulation is safer for the electrical environment. The engagement of the pressing knob 30 and the stopping edge 442 can achieve multi-plane contacts, and when the driving head 40 is locked the stability of driver has a significant improvement.

Although the present invention has been explained in relation to its preferred embodiment, it is to be understood that many other possible modifications and variations can be made without departing from the spirit and scope of invention as hereinafter claimed.

What is claimed is:

1. An insulating ratchet driver with a pivoting head comprising:

a handle, a spring, a pressing knob, a driving head, and a pivoting member, the pivoting member provided with a cover made of an electrically insulating material, all metal portions of the handle, the pressing knob and the driving head being coated with an electrically insulating layer;

wherein:

an end of the handle has an assembling portion, the assembling portion has an opening, a side of the assembling portion provided with a first pivoting aperture and a socket passing through the opening, the socket disposed adjacent to the handle, and the spring and the pressing knob are disposed in the socket;

the pressing knob has a first end and a second end, an escaping gap provided between the first end and the second end on a bottom of the pressing knob, and the spring disposed in the socket respectively pushes the socket and the second end of the pressing knob;

the driving head has a main body provided with a connecting rod driven by a ratchet unit, another end of the main body provided with a toothed wheel, a stopping edge provided between each tooth of the toothed wheel, each stopping edge extending along a lateral side of the toothed wheel, the toothed wheel further provided with a second pivoting aperture, the toothed wheel of the driving head disposed in the opening of the handle, the second pivoting aperture of the toothed wheel aligned with the first pivoting aperture of the opening, the pivoting member disposed in the in the first and second pivoting apertures, and the driving head is pivoted onto the assembling portion of the handle via the toothed wheel, and the pressing knob is biased by the spring to urge the escaping gap away from the opening of the handle, such that the pressing knob engages with two teeth of the toothed wheel and pushed against the stopping edge.

2. The insulating ratchet driver with pivoting head as claimed in claim 1, wherein the pivoting member is screwed together with the pivoting aperture of the handle.

* * * * *